US009593816B2

(12) United States Patent
Johannsson

(10) Patent No.: US 9,593,816 B2
(45) Date of Patent: Mar. 14, 2017

(54) FLAMELESS CANDLE WITH SIMULATED FLAME MOVEMENT

(71) Applicant: Spalero Limited, Hong Kong (HK)

(72) Inventor: Throstur Runar Johannsson, Hong Kong (HK)

(73) Assignee: SPALERO LIMITED, Hong Kong (HK)

( * ) Notice: Subject to any disclaimer, the term of this patent is extended or adjusted under 35 U.S.C. 154(b) by 183 days.

(21) Appl. No.: 14/526,145

(22) Filed: Oct. 28, 2014

(65) Prior Publication Data

US 2016/0116126 A1 Apr. 28, 2016

(51) Int. Cl.

| | |
|---|---|
| ***F21S 10/04*** | (2006.01) |
| *F21S 6/00* | (2006.01) |
| *F21W 121/00* | (2006.01) |
| *F21Y 101/00* | (2016.01) |

(52) U.S. Cl.

CPC ..... *F21S 10/046* (2013.01); *F21S 6/001* (2013.01); *F21W 2121/00* (2013.01); *F21Y 2101/00* (2013.01)

(58) Field of Classification Search

CPC ..... F21S 10/046; F21S 6/001; F21V 14/02
See application file for complete search history.

(56) References Cited

U.S. PATENT DOCUMENTS

| | | | | |
|---|---|---|---|---|
| D589,176 | S * | 3/2009 | Huang | D26/4 |
| 2014/0177212 | A1* | 6/2014 | Li | F21S 6/001 362/190 |
| 2014/0211458 | A1 | 7/2014 | Lai | |

FOREIGN PATENT DOCUMENTS

| | | | |
|---|---|---|---|
| CN | 202647569 | U | 1/2013 |
| CN | 203036543 | U | 7/2013 |
| WO | 2013/189187 | A1 | 12/2013 |

OTHER PUBLICATIONS

PCT International Search Report, dated Jan. 8, 2016, issued in International Patent Application No. PCT/2015/057371, 5 pages.

* cited by examiner

*Primary Examiner* — Andrew Coughlin
*Assistant Examiner* — Meghan Ulanday
(74) *Attorney, Agent, or Firm* — Nixon Peabody, LLP; Khaled Shami

(57) ABSTRACT

A flameless candle having a light-emitting flame-shaped member configured to move in a tilting or oscillating motion. The light-emitting flame-shaped member is joined to a connecting rod driven by a crank, the connecting rod having a pin received along a groove, or having a groove to house a pin, where the pin moves in a reciprocating motion causing the light-emitting flame-shaped member to move in a tilting and oscillating motion.

21 Claims, 4 Drawing Sheets

FLAMELESS CANDLE WITH SIMULATED FLAME MOVEMENT

FIELD OF THE INVENTION

The present invention relates generally to lighting apparatuses and, more particularly, to an imitation candle with a moving, simulated flame.

BACKGROUND OF THE INVENTION

Electric lighting has not entirely replaced the desire to use flames and candles for providing light. Candles are appealing as decorations and for their gentle, low light. However, candles may be hazardous, capable of causing fires from the burning flame, and damage from hot wax. Other shortcomings of candles include how easily their flames are extinguished in the presence of wind and moisture, and how short of a period they last before their wax is consumed.

Electric candles have been introduced to provide safe, electric-powered light while retaining the decorative and appealing qualities of candles. Small votive designs with a static bulb housed in hard plastic materials have been widely used. Recently, pillar designs with a housing made of wax have also been popular because the wax allows such electric pillar candles to appear more realistic.

Different techniques have been employed for creating a more realistic output of light in flameless candles. In one approach, LEDs, which provide the light source, are driven with a variable current to simulate the flickering effect of a burning flame. In another approach, light from LEDs is projected against a reflective and translucent flame-shaped object which extends from a wax housing to simulate the light of a burning flame. To simulate flickering, in one example, a fan operating inside the candle housing blows air onto the flame-shaped object, causing it to move. In another example, a magnetic field produced around the flame-shaped object causes it to move.

BRIEF SUMMARY OF PREFERRED EMBODIMENTS OF THE INVENTION

Present embodiments of the invention provide a flameless candle with a crank and connecting rod mechanism housed inside the candle for generating movement for a flame-shaped member. A motor rotationally drives a crank member connected to a rod that is coupled to the flame-shaped member, allowing the flame-shaped member to move in unity with the tilting and oscillating motion of the end of the connecting rod. A light source located apart from the flame-shaped member may project light onto the flame-shaped member. The flame-shaped member may house a light source that provides a flickering light. The crank, connecting rod, and flame-shaped member assembly may also move rotationally, providing further variation in movement. The oscillating and tilting motion of the flame-shaped member, coupled with the various light sources, provides a realistic appearance of a burning flame.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

Figure 1:
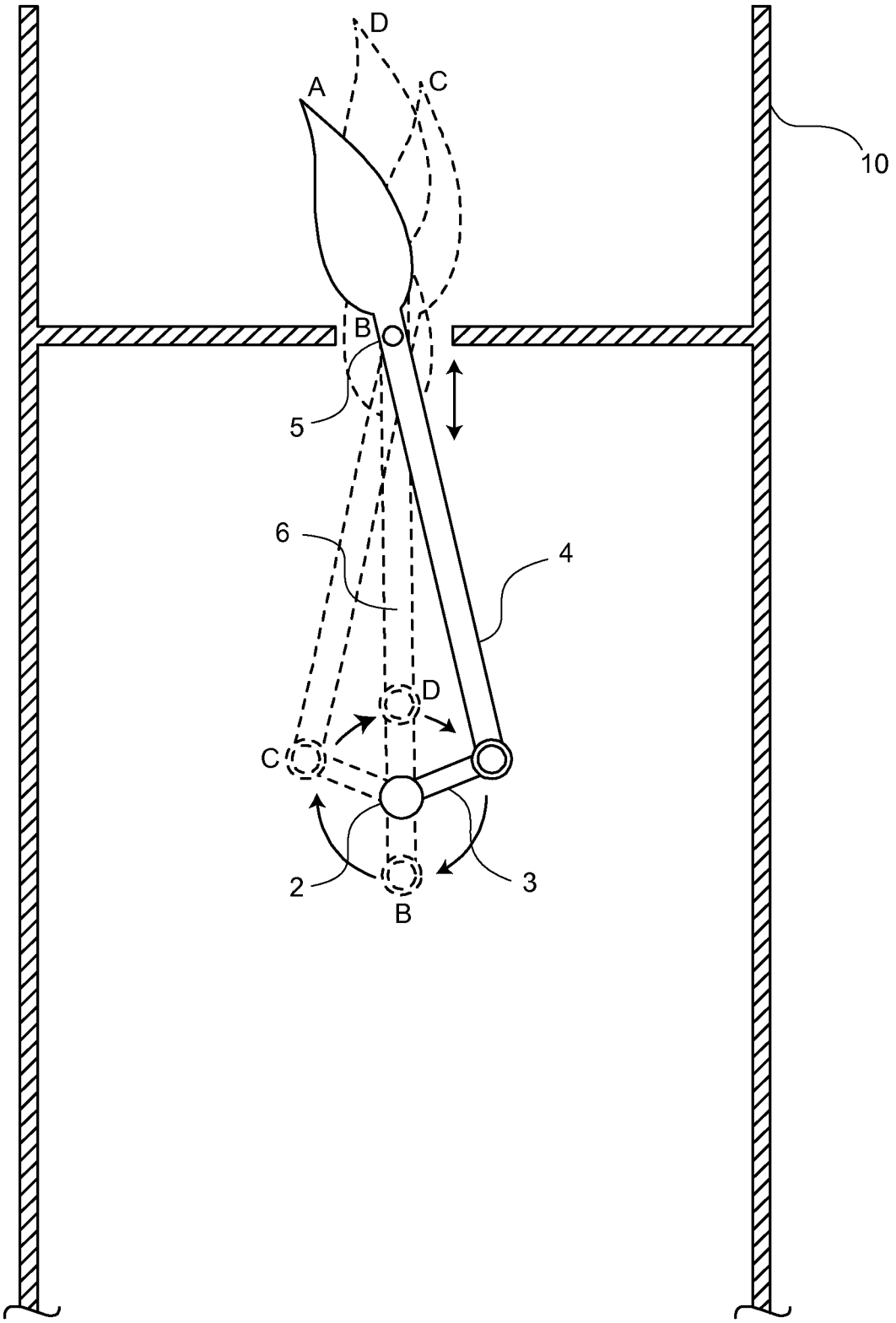
FIG. 1 shows an example of a crank, connecting rod and flame-shaped member assembly of a flameless candle according to some embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION OF PREFERRED EMBODIMENTS OF THE INVENTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention. These embodiments are not intended to limit the present invention to any specific example, environment, application, or particular implementation described herein. Therefore, descriptions of these example embodiments are only provided for purpose of illustration rather than to limit the present invention.

A crank or crankshaft and connecting rod assembly are used to provide an oscillating and tilting motion for a flame-shaped member of a flameless candle. With reference to FIG. 1, a flameless candle comprises a flame-shaped member 1, a connecting rod 4 joined to the flame-shaped member 1 at one end, and joined to a crank 3 at the other end, and a drive shaft 2 coupled to the crank 3 at one end, and coupled to a motor at the other end, configured to provide a rotational movement for crank 3. While connecting rod 4 is described as joined to the flame-shaped member 1, the two may be formed from a single, continuous piece of material without any perceivable or actual joints. While drive shaft 2 is described as coupled to an electric motor, it is understood that other rotation methods may be employed, including by using a spiral torsion spring, such as a mainspring, or other winding-up mechanism.

The connecting rod 4 has a pivot point 5 having a pin, peg, or other appendage that constrains the movement of the pivot point 5 to within a groove 6 along which the pin travels in a reciprocating, or up-and-down, linear motion. As the crank 3 is turned, the connecting rod 4 provides an oscillating and tilting motion to the flame-shaped member 1. For example, as shown, the movement of flame-shaped member 1 starts at position A, straightens and moves through position B at its lowest point, tilts into position C, and rises and straightens into position D, where it will tilt toward position A to repeat the movement cycle.

While the crank 3 and connecting rod 4 are shown in a particular length, it is understood by those of ordinary skill that different combinations of crank 3 and connecting rod 4 length are possible without departing from the scope of the invention. The length of the crank 3 and the length of the connecting rod 4 will determine the degree of tilting and linear displacement of the flame-shaped member. A longer crank 3 and a shorter connecting rod 4 will result in a greater tilt and linear motion. A shorter crank 3 and a longer connecting rod 4 will result in a slighter tilt and linear motion, and may provide a more realistic appearance for the flame-shaped member.

Realistic movements may also be achieved by configuring the crank 3 to move at varying angular velocities. In some embodiments, the variation is achieved by varying the power to an electric motor driving the drive shaft 2.

The movement assembly is housed inside housing 10. The housing 10 may be an imitation housing made from paraffin wax, beeswax, plastic, other material for imitating a candle. Housing 10 may also be any housing suitable for containing the movement mechanism.

Figure 2:
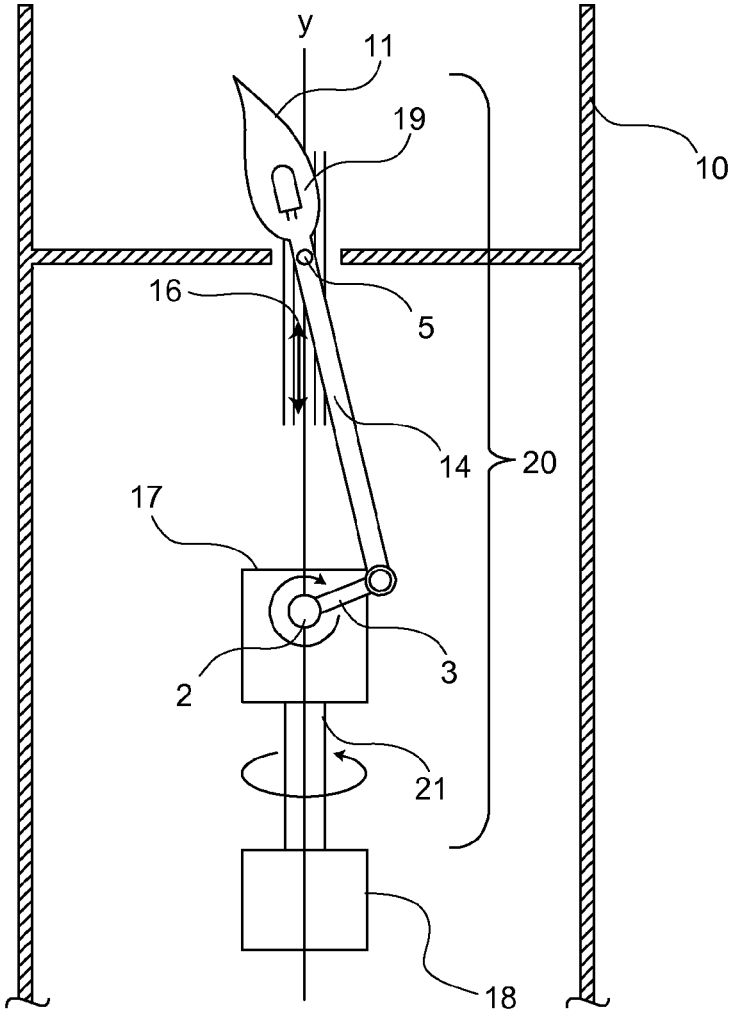
FIG. 2 shows an example of a crank, connecting rod and flame-shaped member assembly with an internal light source and with a rotating base according to some embodiments.
Figure 3:
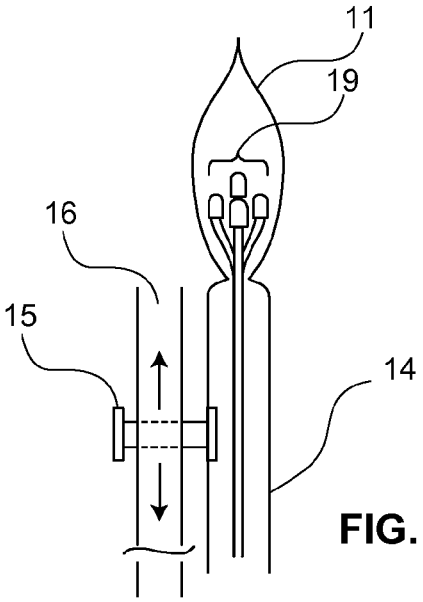
FIG. 3 shows a side and enlarged view of the flame-shaped member assembly of a flameless candle with a rotating base as shown in FIG. 2.

FIGS. 2 and 3 illustrate an example of a flameless candle with a crank, connecting rod, and flame-shaped member assembly having an internal light source for illuminating the flame-shaped member from within a transparent or translucent flame-shaped housing, according to some embodiments. The flame-shaped member of the flameless candle shown in FIG. 2 moves in a tilting and oscillating manner similar to the manner described with respect to FIG. 1 above.

Additionally, the flameless candle as shown comprises a flame-shaped member 11 having a cavity for receiving a light source 19 therein. Flame-shaped member 11 includes any flame-shaped object capable of emitting light directly from an internal source or from an external source. According to some embodiments, a light-emitting flame-shaped member 11 receives or holds one or more light sources inside the flame-shaped member 11. In some embodiments, flame-shaped member 11 is made from a transparent or translucent material. Variations in the surface texture of flame-shaped member 11 may be used to refract and scatter light, to provide the effect of flickering light. Varying voltage to the light source 19 also contributes to the flickering effect. Light sources may include light-emitting diodes (LEDs), or other bulb, depending on the size and scale of the flameless candle.

While the light source 19 is described as housed internally within the flame-shaped member 11, it is understood that the flame-shaped member 11 may not be hollow, and the light source 19 may be externally projected onto the flame-shaped member 11, without departing from the spirit or scope of the invention. For example, according to some embodiments, a light-emitting flame-shaped member 11 does not produce light from the member, but instead may be a flame-shaped object that reflects, refracts, or transmits light that is externally and remotely shone onto it.

In this example, as shown in the side view of FIG. 3, connecting rod 14 is a hollow conduit for a plurality of electrical wires. Also shown is the pin 15 of pivot point 5 coupled to connecting rod 14, as constrained by configured to move in reciprocating motion within groove 16.

In this example, the flame assembly 20 is additionally coupled to a shaft 21 that provides rotational movement along the longitudinal y-axis. In some embodiments, the shaft 21 is driven by motor 18, while the crank 3 and shaft 2 are driven by motor 17. In some embodiments, both shaft 21 and shaft 2 are driven by the same motor (not shown) through the use of one or more gears coupled to the shafts 2 and 21. The rotational motion along the y-axis, together with the tilting and oscillating motion provided by the crank and connecting rod and the flickering effect of the light source provide a more realistic appearance for the flame-shaped member 11.

Figure 4:
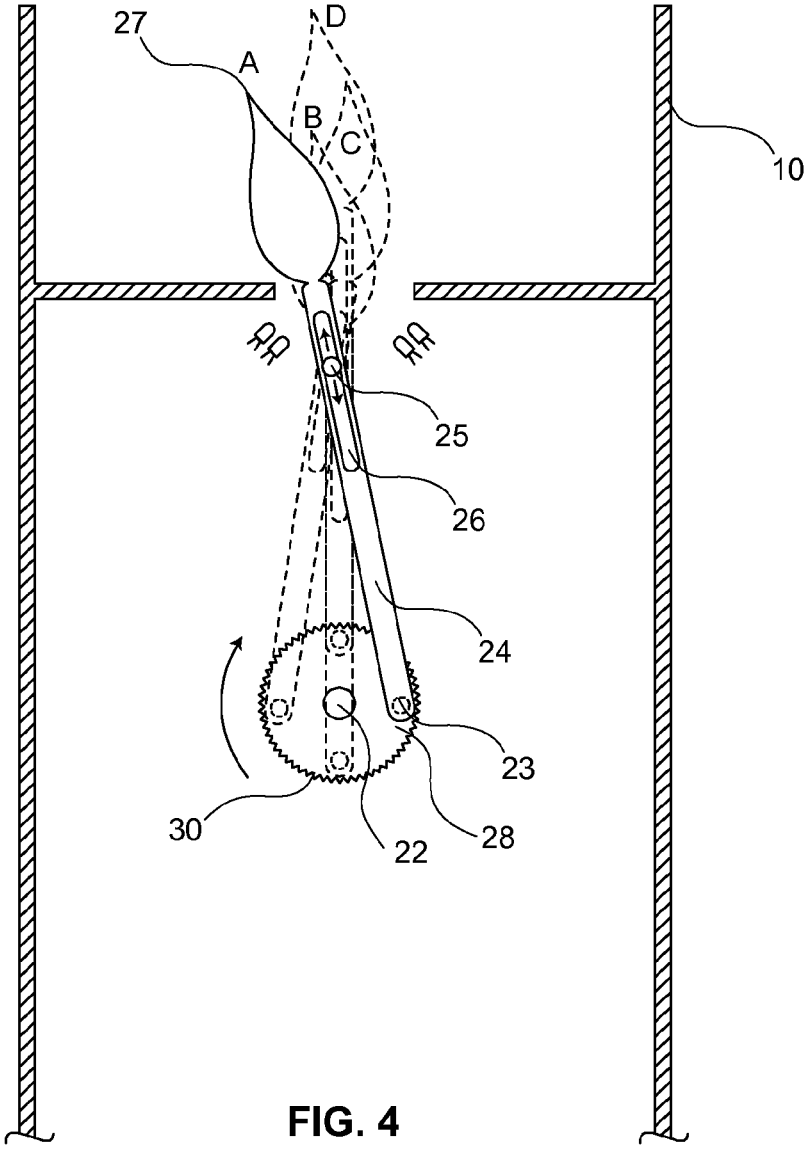
FIG. 4 shows an example of a circular crank, connecting rod and a substantially flat flame-shaped member assembly with an external light source according to some embodiments.
Figure 5:
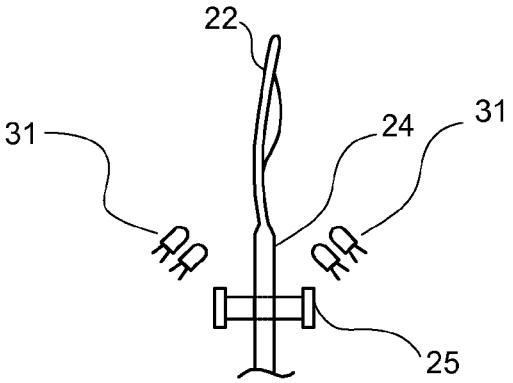
FIG. 5 shows a side and enlarged view of the substantially flat flame-shaped member assembly with external light source according to some embodiments.

In another example of some embodiments as shown in FIGS. 4 and 5, a flameless candle comprises a flame-shaped member 27, which is a substantially flat piece of material. A connecting rod 24 is joined to flame-shaped member 27 at one end, and a pivot point 23 at the other end. The connecting rod 24 includes a groove 26 for receiving pivot point 25, which comprises a pin, peg, or any appendage fixed to a single location and inserted into groove 26. While connecting rod 24 is described as joined to the flame-shaped member 27, the two may be formed from a single, continuous piece of material without any perceivable or actual joints.

In this example, pivot point 23 is coupled to disk 28, which rotates along pivot point 22 and serves as a crank for the connecting rod 24. Disk 28 may consist of a gear having a plurality of teeth 30. In some embodiments, disk 28 may be turned by force applied by a drive shaft coupled to an electric motor at pivot point 22. In some embodiments, disk 28 may be turned by forced applied by another gear on the teeth of disk 28. As disk 28 rotates, connecting rod 24 is constrained at groove 26, holding pivot point 25, causing flame-shaped member 27 to move in a tilting and oscillating motion. For example, as shown, the movement of flame-shaped member 27 starts at position A, straightens and moves through bottom position B at its lowest point, tilts into position C, and rises and straightens into position D, where it will tilt toward position A and repeat the movement cycle.

In some embodiments, light-emitting flame-shaped member 27 and connecting rod 24 are substantially flat. Accordingly, light-emitting flame-shaped member 27 is illuminated by one or more light sources 31 external and remote to the light-emitting flame-shaped member 27. Accordingly, a light-emitting flame-shaped member 27 does not produce light from the member, but instead may be a flame-shaped object that reflects, refracts, or transmits light that is externally shone onto it. Variations in the surface texture or shape of flame-shaped member 27, for example, in being curved, provide variations in the reflected light during the tilting and oscillating movement to help achieve a more realistic or appealing effect. Varying voltage to the light sources 31 also contributes to the flickering effect. Additionally, the tilting and oscillating mechanism shown in FIG. 4 may also be rotated along the y-axis in a manner as described in FIG. 2 for achieving additional light effects.

Figure 6:
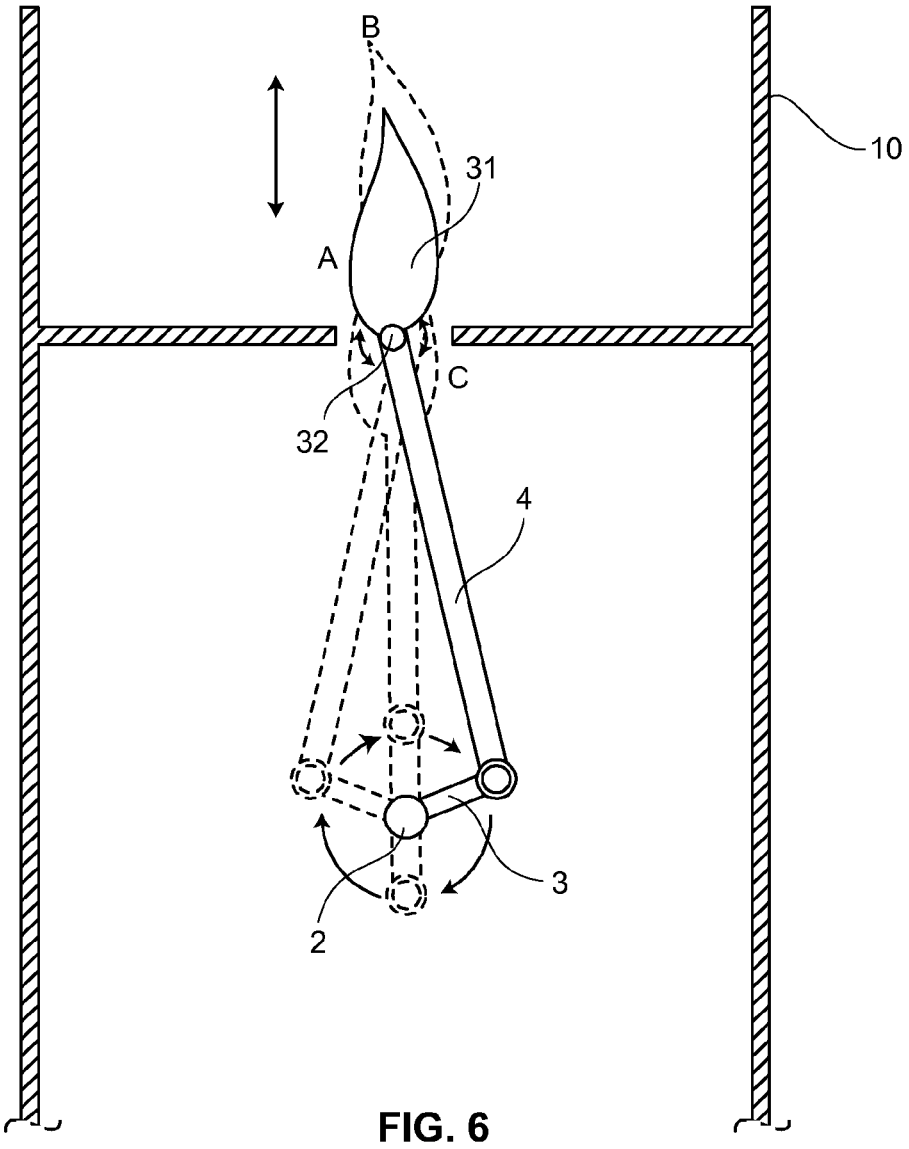
FIG. 6 shows an example of a crank, connecting rod and flame-shaped member assembly that provides for a vertical movement of the flame-shaped member when the assembly is in motion according to some embodiments.
Figure 7:
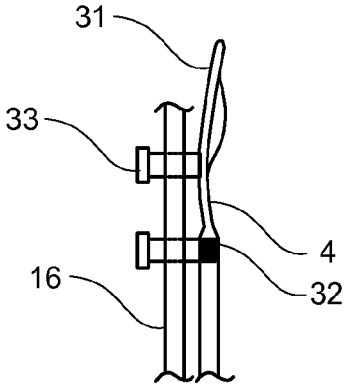
FIG. 7 shows a side and enlarged view of the substantially flat flame-shaped member assembly with a vertically guiding flame appendage according to some embodiments.

In another example of some embodiments as shown in FIG. 6, a flame-shaped member 31 of a flameless candle is configured to slide in a reciprocating linear motion by the motion of the crank and connecting rod. The flameless candle comprises a flame-shaped member 31, and a connecting rod 4 pivotably joined at pivot point 32 the flame-shaped member. The crank 3 is connecting to drive shaft 2, which is rotated by an electric motor or other rotation methods, including by using a spiral torsion spring, such as a mainspring, or other winding-up mechanism. Pivot point 32 has a pin, peg, or other appendage that constrains the movement of the pivot point 32 to within groove 16 along which the pin travels in a reciprocating linear motion. The flame-shaped member 31 pivots relative to the connecting rod 4, and also has an appendage 33 (shown in FIG. 7) that is constrained to move within groove 16 in a reciprocating linear motion. As the crank is turned, it causes the flame-shaped member 31 to move up and down, with the mechanics of the pivot point 32 and appendage 33 constraining the motion of the light-emitting flame-shaped member 31 to an axial direction while maintaining its orientation.

While the examples shown in FIGS. 1-7 have flame-shaped members that are either substantially flat and illuminated by external light sources, or are translucent and hollow for receiving a one or more light sources within, it is understood that light-emitting flame-shaped members may include any flame-shaped object illuminated in any manner without departing from the scope and spirit of the invention. In some embodiments, the connecting rod may terminate in wick, which when lit by fire, becomes an actual flame that may be moved.

One advantage of a flameless candle having a crank and connecting rod mechanism for applying movement to a flame-shaped member is the ability to scale the mechanism according to the size of the candle. Embodiments of this invention may be used to simulate the movement of a burning flame in regular, large or small scale models of candles.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Various additions, deletions and modifications are contemplated as being within its scope. The scope of the invention is, therefore, indicated by the appended claims rather than the foregoing description. Further, all changes which may fall within the meaning and range of equivalency of the claims and elements and features thereof are to be embraced within their scope.

What is claimed is:

1. An assembly for providing movement to a light-emitting flame-shaped member, comprising:

a light-emitting flame-shaped member;

a connecting rod pivotably attached to the light-emitting flame-shaped member at a first portion of the connecting rod;

at least one appendage attached to the light-emitting flame-shaped member;

a groove for receiving the at least one appendage and constraining the motion of the at least one appendage, and the light-emitting flame-shaped member attached thereto, to a reciprocating motion along a direction of the groove, the reciprocating motion maintaining an orientation of the light-emitting flame-shaped member;

a crank pivotably attached to the connecting rod at a second portion of the connecting rod;

the crank configured to rotate about a rotational axis, said crank rotation imparting said constrained reciprocating motion to the light-emitting flame-shaped member.

2. The assembly of claim 1, wherein the light emitted by the light-emitting flame-shaped member is light that is:

sourced at the light-emitting flame-shaped member and emitted thereby; or sourced at a remote transmitter and is any one or more of reflected, refracted, or transmitted by the light-emitting flame-shaped member.

3. The assembly of claim 1, the crank configured to be rotated by a drive shaft rotated by an electric motor.

4. The assembly of claim 1, the crank configured to be rotated by a drive shaft rotated by a spiral torsion spring.

5. The assembly of claim 1, wherein the light-emitting flame-shaped member is substantially translucent and hollow, and configured to receive a lighting source within the light-emitting flame-shaped member for illuminating said light-emitting flame-shaped member.

6. The assembly of claim 5, wherein the connecting rod includes a conduit through which electrical wiring from the light source passes.

7. The assembly of claim 1, wherein the light-emitting flame-shaped member comprises a thin, rigid and substantially flat material.

8. The assembly of claim 1, wherein the assembly is further configured to rotationally move along a longitudinal axis.

9. An assembly for providing movement to a light-emitting flame-shaped member, comprising:

a light-emitting flame-shaped member;

a connecting rod rigidly attached to the light-emitting flame-shaped member at a first portion of the connecting rod;

an appendage rigidly attached to the first portion of the connecting rod;

a groove for receiving the appendage and constraining the first portion of the connecting rod, and the light-emitting flame-shaped member rigidly attached thereto, for motion along a direction of the groove;

a crank pivotably attached to the connecting rod at a second portion of the connecting rod, the crank configured to rotate about a rotational axis to thereby impart said constrained motion and a tilting motion to the light-emitting flame-shaped member.

10. The assembly of claim 9, wherein the light emitted by the light-emitting flame-shaped member is light that is:

sourced at the light-emitting flame-shaped member and emitted thereby; or sourced at a remote transmitter and is any one or more of reflected, refracted, or transmitted by the light-emitting flame-shaped member.

11. The assembly of claim 9, the crank configured to be rotated by any one or more of drive shaft rotated by an electric motor or a spiral torsion spring.

12. The assembly of claim 9, wherein the light-emitting flame-shaped member is substantially translucent and hollow, and configured to receive a lighting source within the light-emitting flame-shaped member.

13. The assembly of claim 9, wherein the connecting rod includes a conduit through which electrical wiring from the light source passes.

14. The assembly of claim 9, wherein the light-emitting flame-shaped member comprises a thin, rigid and substantially flat material.

15. An assembly for providing movement to a light-emitting flame-shaped member, comprising:

a light-emitting flame-shaped member;

a connecting rod rigidly attached to the light-emitting flame-shaped member at a first portion of the connecting rod, the connecting rod including a slot for slidably receiving a pin therein;

a crank pivotably attached to the connecting rod at a second portion of the connecting rod, the crank imparting sliding motion between the pin and the connecting rod such that the light-emitting flame-shaped member moves in a tilting motion, and in a and reciprocating motion in the direction of the slot of the connecting rod, in accordance with the motion of the connecting rod.

16. The assembly of claim 15, wherein the light emitted by the light-emitting flame-shaped member is light that is:

sourced at the light-emitting flame-shaped member and emitted thereby; or sourced at a remote transmitter and is any one or more of reflected, refracted, or transmitted by the light-emitting flame-shaped member.

17. The assembly of claim 15, the crank configured to be rotated by a drive shaft rotated by an electric motor.

18. The assembly of claim 15, the crank configured to be rotated by a drive shaft rotated by a spiral torsion spring.

19. The assembly of claim 15, wherein the light-emitting flame-shaped member is substantially translucent and hollow, and configured to receive a lighting source within the light-emitting flame-shaped member.

20. The assembly of claim 15, wherein the connecting rod includes a conduit through which electrical wiring from the light source passes.

21. The assembly of claim 15, wherein the light-emitting flame-shaped member comprises a thin, rigid and substantially flat material.

* * * * *